US005885139A

United States Patent [19]

Lemieux et al.

[11] Patent Number: 5,885,139

[45] Date of Patent: Mar. 23, 1999

[54] FLOOR COVERING STRIPPING AND FLOOR RE-SURFACING MACHINE

[76] Inventors: Francois Lemieux, 683, Nicolas Str., Grande-ile, Canada, J6S-5V4; Claude Bissonnette, 122, Rapin Str., St-Timothee, Canada, J6S-5M5

[21] Appl. No.: 912,312

[22] Filed: Jul. 15, 1997

[51] Int. Cl.[6] ..... B24B 7/18

[52] U.S. Cl. ..... 451/69; 451/461; 15/93.1

[58] Field of Search ..... 451/69, 353, 350, 451/359, 461; 15/4, 93.1, 236.1

[56] References Cited

U.S. PATENT DOCUMENTS

| | | | |
|---|---|---|---|
| 0,895,497 | 8/1903 | Pliske | 451/69 |
| 2,738,966 | 3/1956 | Davis | 15/93.1 |
| 3,098,329 | 7/1963 | Doran . | |
| 3,934,377 | 1/1976 | Tertinek . | |
| 4,614,380 | 9/1986 | Allen . | |
| 4,626,033 | 12/1986 | Anderson . | |
| 4,668,017 | 5/1987 | Peterson et al. . | |
| 4,675,975 | 6/1987 | Kucharczyk et al. | 451/461 |
| 4,758,050 | 7/1988 | Peterson et al. . | |
| 4,981,548 | 1/1991 | Poll . | |
| 5,081,734 | 1/1992 | Sandford et al. . | |
| 5,275,470 | 1/1994 | Miller . | |
| 5,409,299 | 4/1995 | Holder . | |
| 5,514,027 | 5/1996 | Pearlman | 451/353 |

*Primary Examiner*—Robert A. Rose

[57] ABSTRACT

A power-operated and hand steerable machine for stripping linoleum, tile, mastic, grout, adhesive and the like from a floor and also for re-surfacing the floor after the stripping operation. The machine includes a support frame, a drive plate driven by a motor about a vertical rotational axis, a reversible work plate mounted under the drive plate and carrying cutter blocks with cutter inserts at one face and abrasive-carrying devices at the opposite face. Therefore, after a floor stripping operation by the cutter inserts, the work plate can be reversed and a floor re-surfacing operation be carried out by using the abrasive-carrying devices. A change speed system enables to drive the work plate at a higher speed during floor re-surfacing than during floor stripping. Longitudinally adjustable weights are carried by the support frame to adjustably bias the work plate against the floor. A vacuum cleaner unit is carried by the support frame and includes an air inlet mouth formed by a shroud carried by the support frame with the mouth in the rotational plane of the work plate. The change speed system includes a driving and a driven pulley and a belt selectively trained in complementary grooves of the two pulleys, the grooves being of different diameters. If the motor is an internal combustion engine, a belt tightening lever is provided; normally it is biased in belt tightening position but can be released by an actuating lever mounted on the handle and accessible to the machine operator.

14 Claims, 6 Drawing Sheets

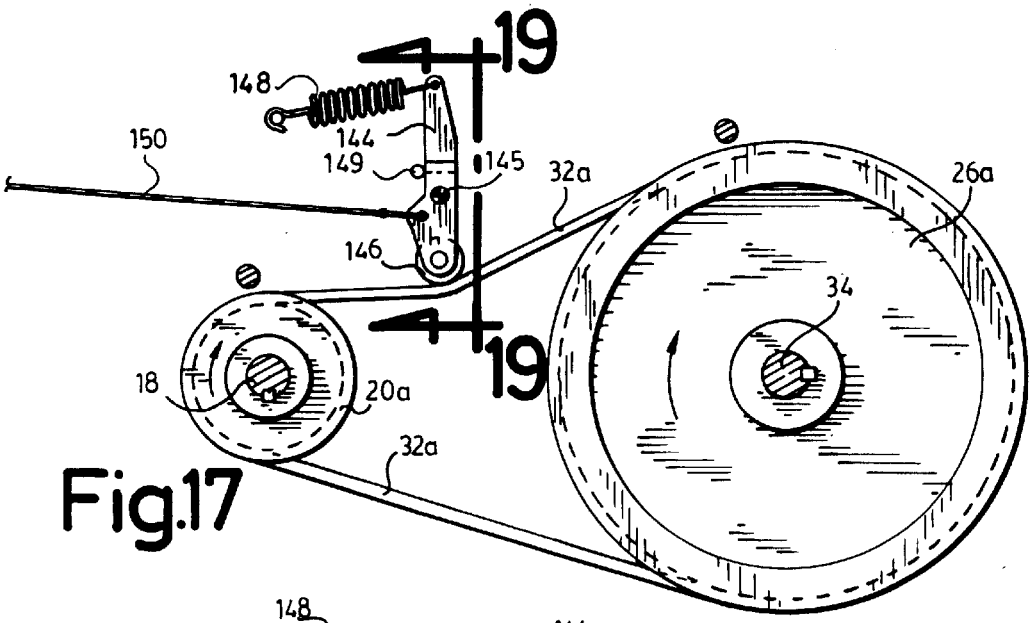
Fig.17
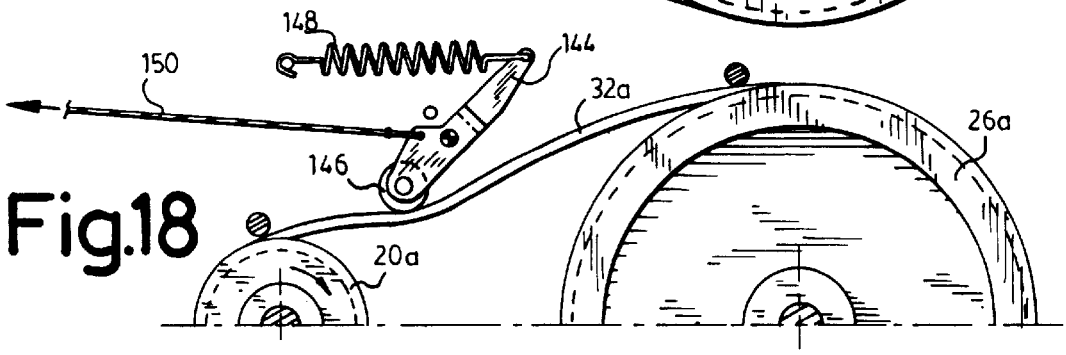
Fig.18
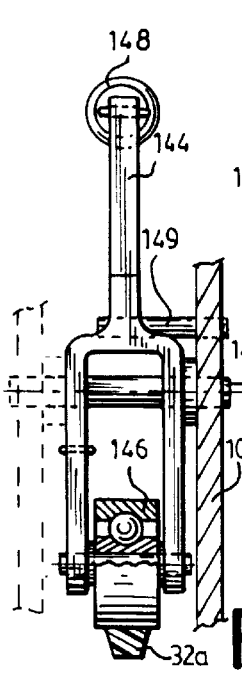
Fig.19
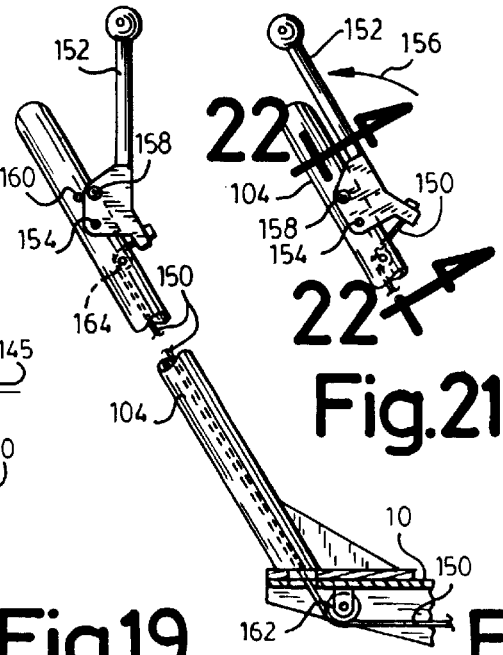
Fig.21
Fig.20
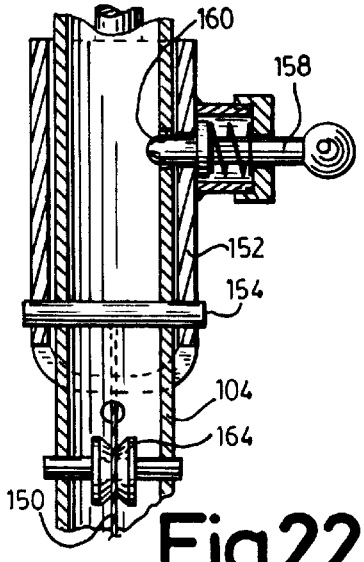
Fig.22

FLOOR COVERING STRIPPING AND FLOOR RE-SURFACING MACHINE

FIELD OF THE INVENTION

The present invention relates to a floor covering stripping machine for removing linoleum, tile, mastic, grout, adhesive and the like from floors.

BACKGROUND OF THE INVENTION

Several types of machines exist on the market for removing tile and the like from a floor. There are also machines specially designed for re-surfacing floors such as wooden floors. However, there do not seem to be any machine that combines the two operations. In known floor covering scraping or removing machines there is an absence of a machine counterbalancing system to adjust the bias of the scraping elements against the floor. Also in known such machines, the cutter inserts must be replaced very often especially when removing ceramic tiles. Such known machines also lack a safety system to stop rotation of the cutters when exposed to excessive counterforce to thereby prevent burning out of the electric motor used for driving the cutters.

OBJECTS OF THE INVENTION

It is therefore the general object of the present invention to provide a machine which will obviate the above-noted disadvantages.

Another object of the present invention is to provide a machine which is capable of effecting in succession two operations, namely floor covering stripping and floor re-surfacing, thereby resulting in a machine which is much less expensive than two separate machines.

Another object of the present invention is to provide a machine of the character described which is capable of applying an adjustable bias against the floor of the cutter inserts and abrasive elements used during stripping and resurfacing respectively.

Another object of the present invention resides in the provision of a machine of the character described in which the cutter inserts have several cutting edges which can be successively used by changing their position on the cutter blocks thereby extending their useful life.

Another object of the present invention resides in the provision of a machine of the character described which has a two-speed transmission, the lower speed being used to drive the cutter inserts and the higher speed used to drive the abrasive or sanding elements.

SUMMARY OF THE INVENTION

The combined floor covering stripping and floor re-surfacing machine of the present invention comprises a support frame;

floor engaging wheels carried by the support frame;

steering means mounted on the support frame for steering the frame across a floor;

motor means mounted on the support frame;

a rotatable drive plate rotated by the motor means under the support frame about a generally vertical axis;

a reversible work plate having two opposite main faces and removably secured to the drive plate under the latter to take a first position with one main face lowermost and a second position with the other main face lowermost;

annularly disposed cutter blocks secured to the reversible work plate at one main face thereof;

a cutter insert secured to each cutter block and protruding from the one main face; and annularly disposed abrasive carrying devices secured to and protruding from the other main face of the reversible work plate whereby both a floor covering stripping operation and a floor re-surfacing operation can be effected by the same machine by securing the work plate to the drive plate in the first and second positions respectively.

The motor means can be a constant speed or a variable speed electric motor or a variable speed internal combustion engine. When the motor means is a constant speed electric motor, the machine further includes a change speed system interconnecting the motor means and the drive plate to enable rotation of the work plate at a lower speed when it is in its first position than when it is in its second position.

Preferably, the change speed system includes a driving and a driven pulley each having two complementary belt receiving grooves of different diameters, and a belt selectively trained in complementary grooves of both pulleys, the belt capable of slipping in the grooves upon application unto the drive plate of a rotation obstructing force exceeding a predetermined value.

Preferably, the steering means includes a handle secured to the support frame and wherein the support frame is elongated and the wheels includes a pair of wheels mounted on each side of the support frame, the drive plate and the handle carried by opposite portions of the support frame relative to the axis of the wheels and further including longitudinally adjustable weights carried by the frame to adjustably bias the work plate against the floor.

Preferably, the machine further includes means to independently adjust the level of each wheel of the pair of wheels relative to the support frame.

Preferably, each cutter block has a front radially extending cutter insert abutting face and a lip forwardly protruding from the face, each cutter insert being a many-sided flat thick blade with a pair of spaced parallel straight cutting edges formed along each side, and a spring-loaded bolt means extending through the cutter block and through the blade and resiliently retaining the blade flat against the cutter insert abutting face with the lip close to one side of the blade to prevent its rotation about the bolt means, the bolt means axially displaceable to permit the blade to clear the lip to be rotated so that another of its sides will come close to the lip, the blade reversibly mounted on the bolt means.

Preferably, the blade is square or hexagonal, each side forming two cutting edges.

Preferably, the machine further includes a power-operated vacuum cleaner unit mounted on the support frame in counterbalancing relation about wheel axis relative to the drive plate and to the motor means, a shroud carried by the support frame and including a skirt surrounding the drive and work plates and an air inlet mouth formed by the skirt in the rotational plane of the work plate and close to the periphery of the latter, the mouth connected to the vacuum cleaner unit.

When the motor means is an internal combustion engine, the machine further includes a belt tightening means comprising a spring-biased belt engaging and tightening first lever mounted on the frame intermediate the driving and driven pulleys and an actuating second lever mounted on the handle and accessible to the operator of the machine, cable means interconnecting the first and second levers and releasable second lever locking means to releasably lock the second lever in a declutching position causing the cable means to maintain the first lever in a belt releasing position against the bias of the spring.

BRIEF DESCRIPTION OF THE ANNEXED DRAWINGS

Figure 1:
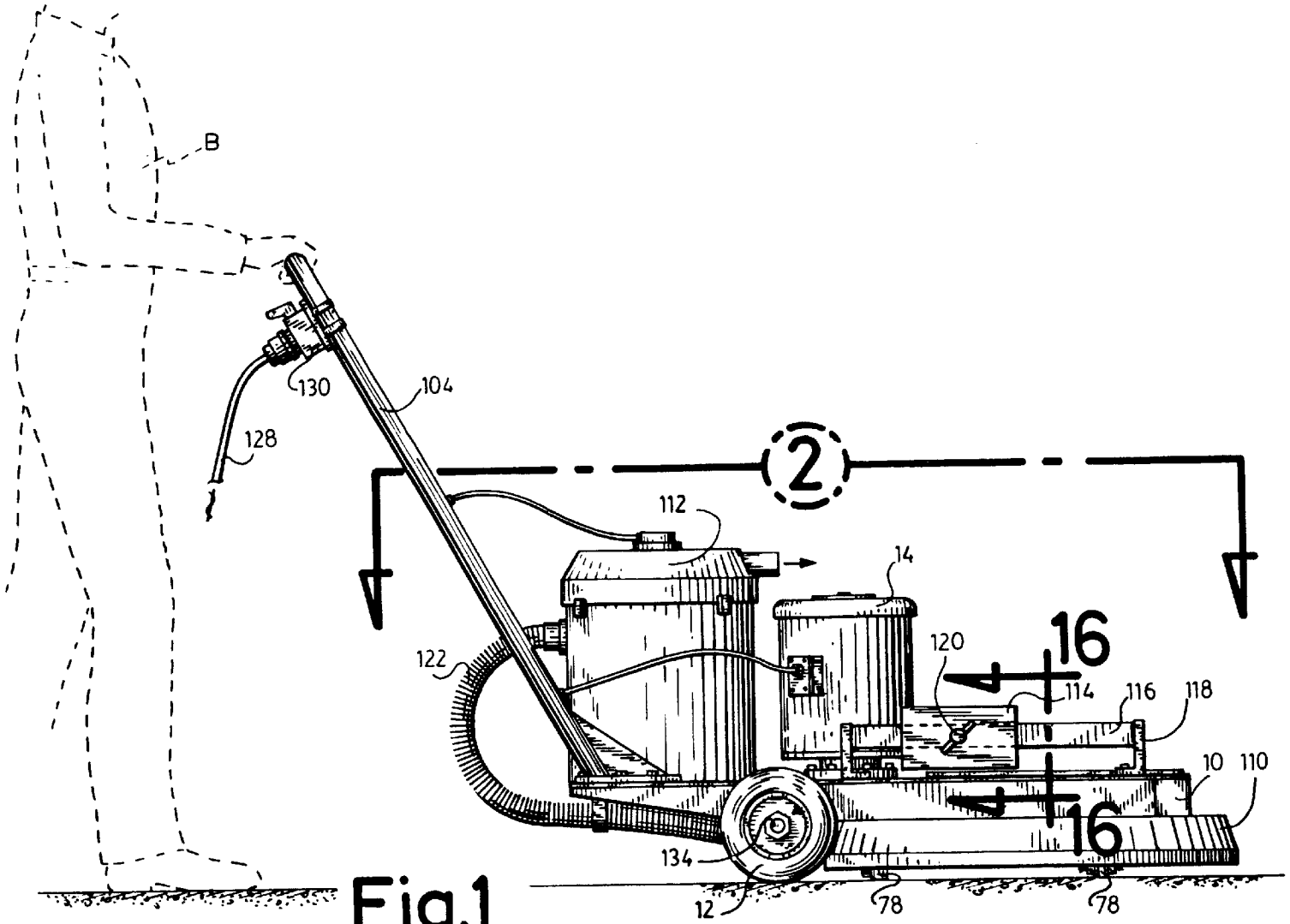
FIG. 1 is a side elevation of the machine in accordance with the invention.
Figure 3:
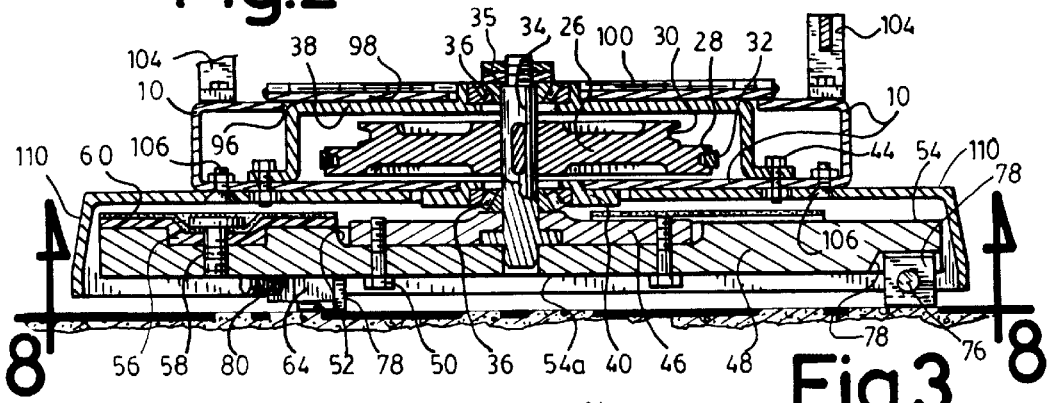
FIG. 3 is a cross-section taken along line 3—3 of FIG. 2.
Figure 9:
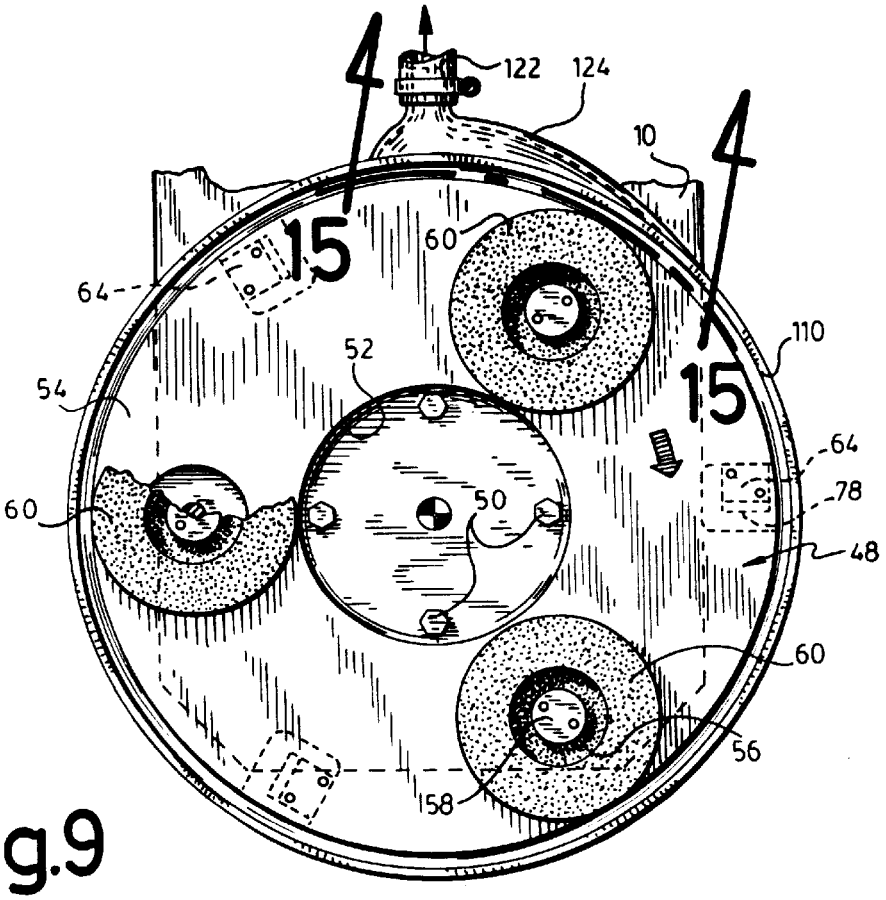
FIG. 9 is a bottom plan view of the machine with the work plate in reverse position and showing the floor sanding elements.
Figure 15:
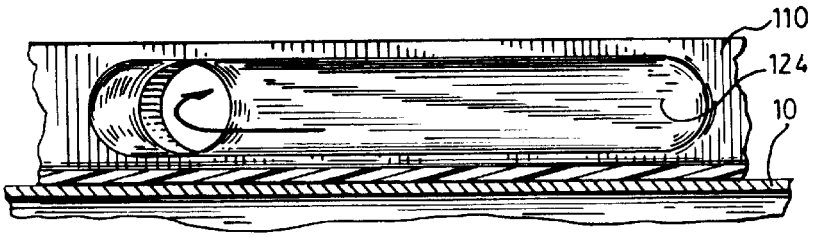
Figure 16:
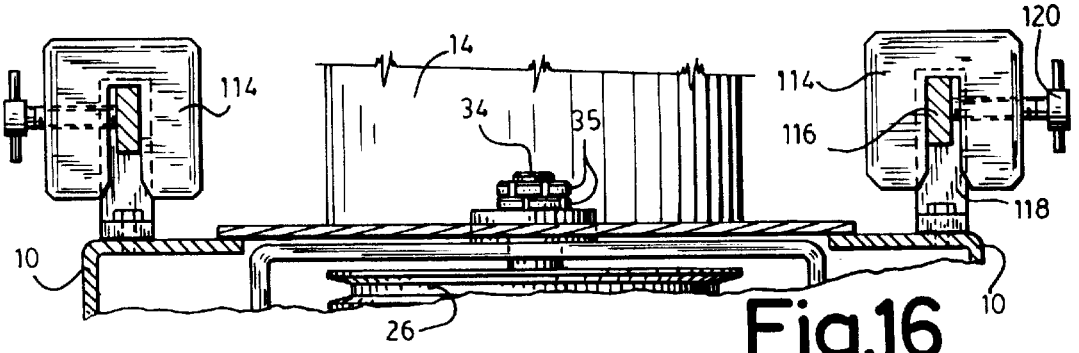
Figure 11:
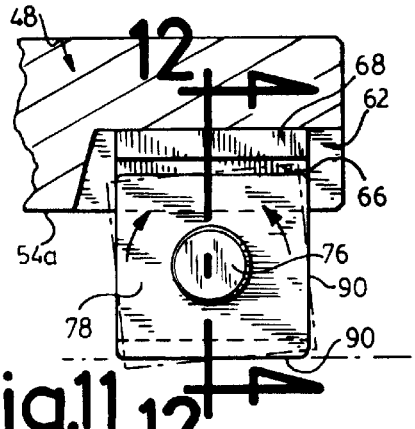
FIG. 11 is a front end view of the elements of FIG. 10.
Figure 11A:
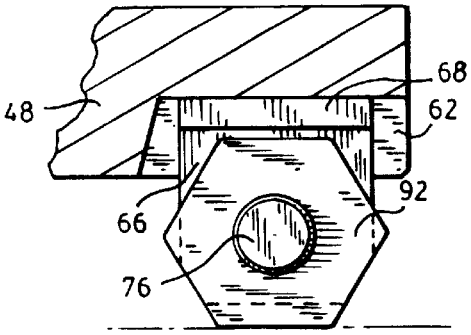
Figure 14:
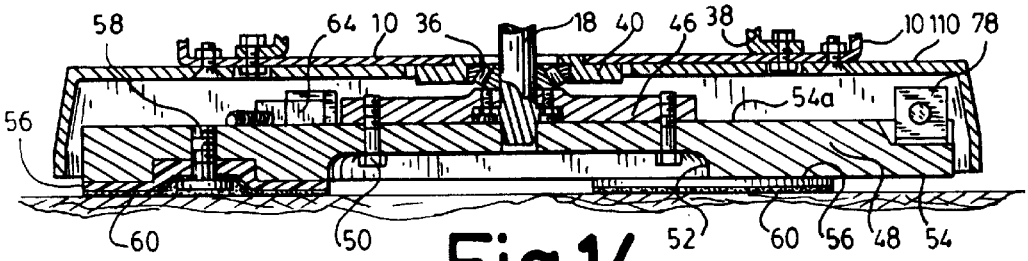

FIG. 11*a* is a view similar to that of FIG. 11, but showing another embodiment of the cutter insert;

FIG. 14 is a transverse section similar to that of FIG. 3 but showing the work plate in reverse position with the floor sanding elements in operative position;

FIG. 15 is a partial section taken along line 15—15 of FIG. 9;

FIG. 16 is a partial section taken along line 16—16 of FIG. 1;

FIG. 17 is a plan view of the belt and pulley transmission with the belt tightening lever in belt tightening or clutching position;

FIG. 18 is a partial view similar to that of FIG. 17 but showing the belt tightening lever in belt leasing position;

FIG. 19 is a partial cross-section taken along line 19—19 of FIG. 17;

FIG. 20 is a partial side elevation of the handle showing the actuating lever in belt tightening position;

FIG. 21 is a partial elevation of the handle and of the actuating lever in belt releasing position; and FIG. 22 is a partial longitudinal section taken along line 22—22 of FIG. 21.

DETAILED DESCRIPTION OF THE PREFERRED EMBODIMENTS OF THE INVENTION

Figure 2:
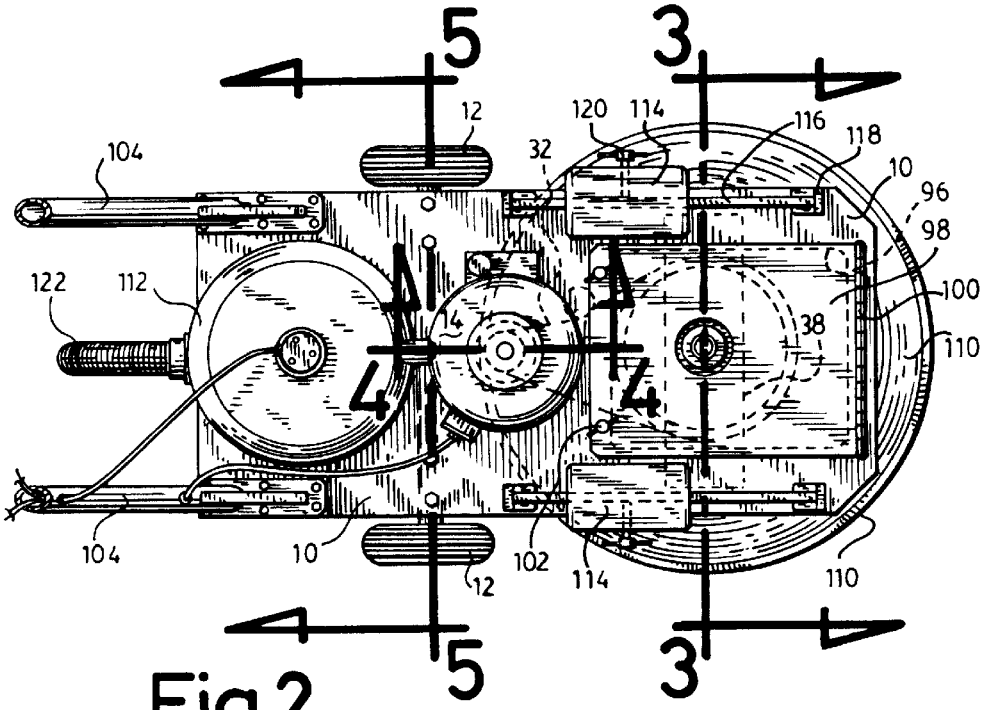
FIG. 2 is a partial top plan view taken along line 2 of FIG. 1.

Referring to FIGS. 1 and 2, the machine of the invention comprises an elongated box-shaped frame 10 provided with a pair of transversely disposed ground engaging wheels 12.

Figure 4:
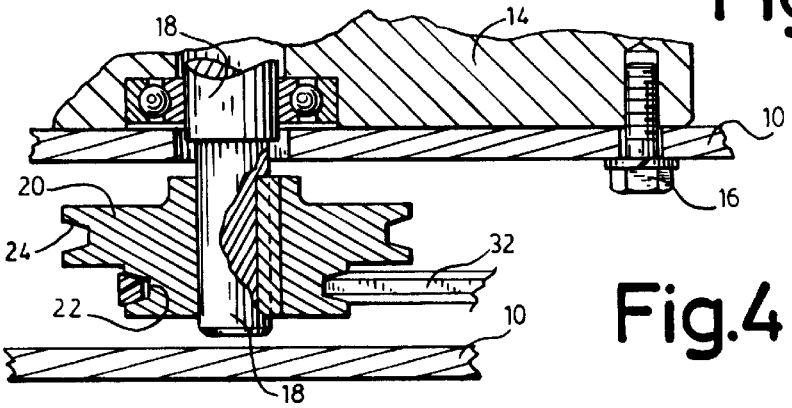
FIG. 4 is an enlarged cross-section taken along line 4—4 of FIG. 2 and showing the driving pulley of the transmission.

A constant speed electric motor 14 is fixed over the support frame 10 by bolts 16 (see FIG. 4) and has a vertical drive shaft 18 to the lower end of which is keyed a drive pulley 20 provided with belt receiving grooves 22, 24 of two different diameters for selectively receiving a belt 32. The machine further includes a driven pulley 26 (FIG. 3), having a larger diameter groove 28 and a smaller diameter groove 30 for receiving belt 32. The belt 32 has a predetermined length and therefore the smaller diameter groove 22 of drive pulley 20 is complementary to the larger diameter groove 28 of driven pulley 26 and also the larger diameter groove 24 is complementary with the smaller diameter groove 30. The driven pulley 26 is mounted on a vertical shaft 34 which is inserted within thrust bearings 36 disposed above and below the driven pulley and carried by a top support bracket 38 and a central ring 40 fixed to the bottom of the box-shaped support frame 10. A nut and lock nut arrangement 35 is used to adjust and secure the vertical shaft 34 within the thrust bearings 36. Brackets 38 and support frame 10 are secured together by bolts 44.

To the lower end of shaft 34 is secured a drive plate 46 in the form of a disc to which is removably secured a co-axial work plate 48 also in the form of a disc, the work plate being secured by bolt 50 to the drive plate 46.

Work plate 48 is reversible; it has at one main face 54 a central recess 52 while its opposite main face 54*a* is flat. The recessed face 54 carries three equally angularly disposed rubber discs 56 of cup shape each centrally secured by a bolt 58 which also secures a sandpaper disc 60 on top of the rubber disc 56. These constitute standard devices for re-surfacing floors such as a wooden floor and are also used in portable sanders.

Figure 10:
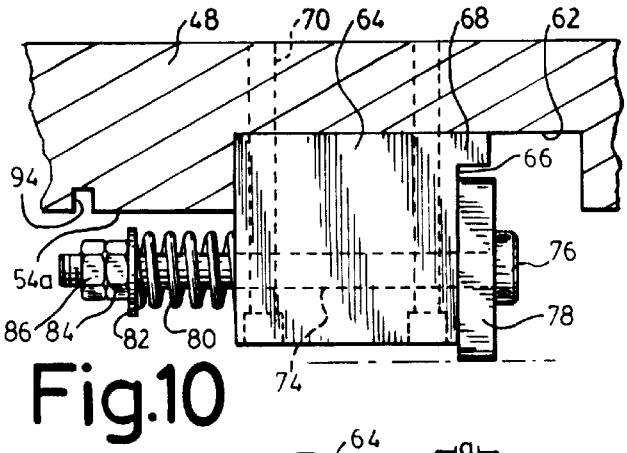
FIG. 10 is a partial cross-section of the work plate showing a cutter block and cutter insert assembly in side elevation.

Within flat face 54*a* is formed three angularly equally spaced cavities 62 near its periphery in each of which is mounted a cutter block 64 which has a radially disposed front face 66 from which protrudes a transverse lip 68. Each cutter block 64 is removably secured to the work plate 48 by bolts 70 (see FIG. 10) and it is provided with a longitudinally extending bore 72 for receiving a cutter insert retaining bolt 74. Bolt 74 has a head 76 which presses a cutter insert 78 against the front face 66 of cutter block 64 under the bias of a coil spring 80 which surrounds the opposite end of the bolt and is applied against the rear face of the cutter block 64 and against a washer 82 held on the bolt by a nut 84 and a lock nut 86.

Figure 12:
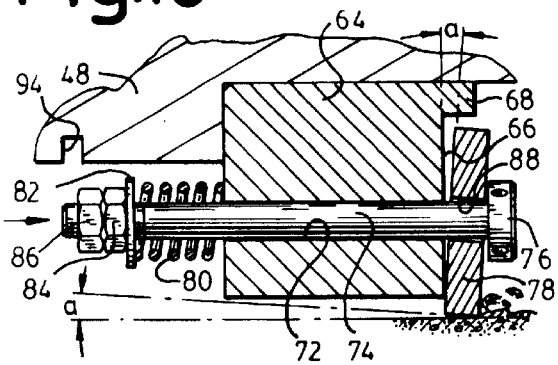
FIG. 12 is a longitudinal section taken along line 12—12- of FIG. 11.

As shown in FIG. 12, bolt 74 has a sliding fit in through-bore 72 but extends through a bore 88 of cutter insert 78 which has a slightly larger diameter than that of the bolt so that the cutter insert 78 may take a maximum inclined position as indicated by $\alpha$ so as to have the proper clearance angle with the surface being scraped. Each cutter insert 78 is a square plate of uniform thickness providing eight straight cutting edges 90.

FIG. 11 shows that an hexagonal cutting insert 92 could be used instead of square cutter insert 78. Such a cutter insert increases the number of available cutting edges to twelve.

Figure 13:
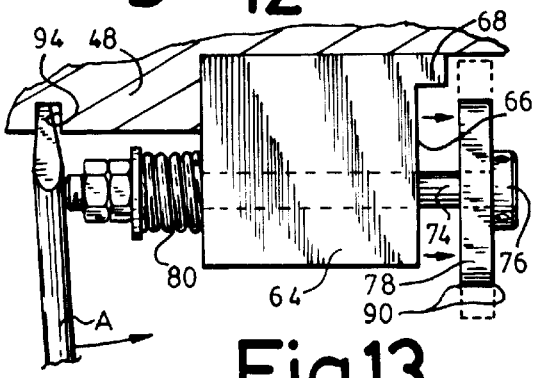
FIG. 13 is a side elevation similar to that of FIG. 10 showing how the cutter insert is rotated.

The cutter insert is prevented from rotation with respect to the cutter block 64 because of interference between one side of the same with the lip 68. Once one cutting edge 90 is worn out, the cutter insert 78 can be displaced forwardly of lip 68 as shown in FIG. 13 by using a screwdriver A or the like which is inserted in a groove 94 of the work plate 78 and which is used as a lever to press the bolt 74 forwardly against the bias of coil spring 80.

Referring to FIGS. 3 and 14, it is noted that the cutter blocks 64 protrude from the flat face 54*a* of the work plate 48 a much greater distance than the protruding extent of the assembly of the rubber discs 56 and sandpaper discs 60 from recessed face 54 of work plate 48. Despite this, the provision of the central recess 52 enables to maintain support frame at the same level over the floor in both positions of work plate 48.

Referring to FIGS. 2 and 3, the top of frame 10 is provided with an access opening 96 which is normally closed by a cover 98 hinged by piano hinge 100 to the top of frame 10 and retained in closed position by wing nuts 102. This enables access to the driven pulley 26 for easy changing of the belt from the groove 28 to the groove 30 and vice versa.

A rearwardly extending U-shaped handle 104 is rigidly secured at its lower ends to the back of frame 10.

The transverse axis of wheels 12 is disposed intermediate the connection of the handle 104 to the frame 10 and motor 14 which is rearward of drive plate 46 and work plate 48.

To the underside of the front part of support frame 10 is secured by bolts 106 a circular plate with a dependent circular skirt forming a shroud 110. Shroud 110 is co-axial with shaft 34 and spacedly surrounds the assembly of drive plate 46 and work plate 48.

A vacuum cleaner 112 is mounted on the rear portion of support frame 10 and serves to counterbalance about the wheels 12 the weight of the drive plate 46, work plate 48 and motor 14. Therefore, the operator B (see FIG. 1), who holds the handle 104, does not normally have to exert any upward or downward force on the machine once the different pressures to be exerted either by the sandpaper disks 60 or the cutter inserts 78 on the floor have been obtained by a pair of removably and longitudinally adjustable weights 114. These weights slide on rails 116 secured over the front section of the support frame 10 by end brackets 118. Their longitudinal adjustment once obtained, they are fixed in position by wing bolts 120 engaging the rails 116.

The vacuum cleaner unit 112 is provided with a standard flexible suction tube 122 which communicates with an air inlet mouth 124 formed by the skirt 110 and disposed in the plane of the work plate 48. Vacuum cleaner 112 and motor 14 are connected to an electric supply cord 128 which is controlled by a switch 130 mounted on the handle 104 and accessible to operator B.

Figure 5:
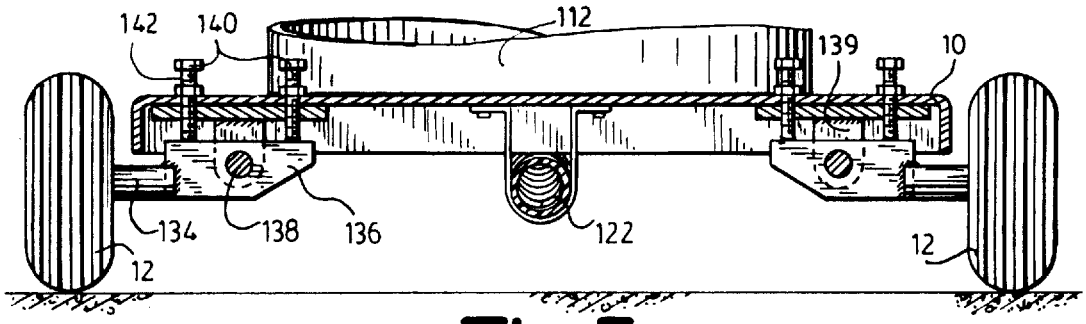
FIG. 5 is a partial cross-section taken along line 5—5 of FIG. 2.
Figure 6:
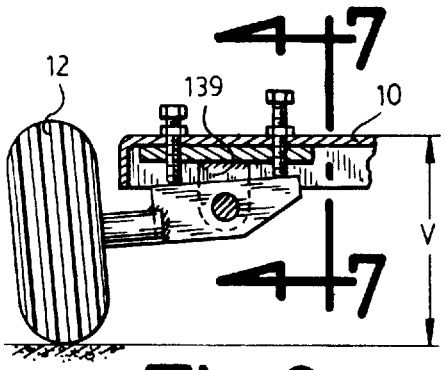
FIG. 6 is a partial cross-section similar to that of FIG. 5 and showing one wheel in another vertically adjusted position.
Figure 7:
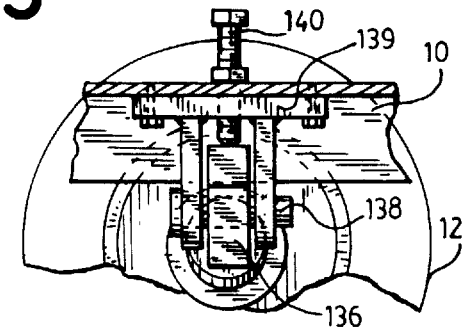
FIG. 7 is a partial section taken along line 7—7 of FIG. 6.
Figure 8:
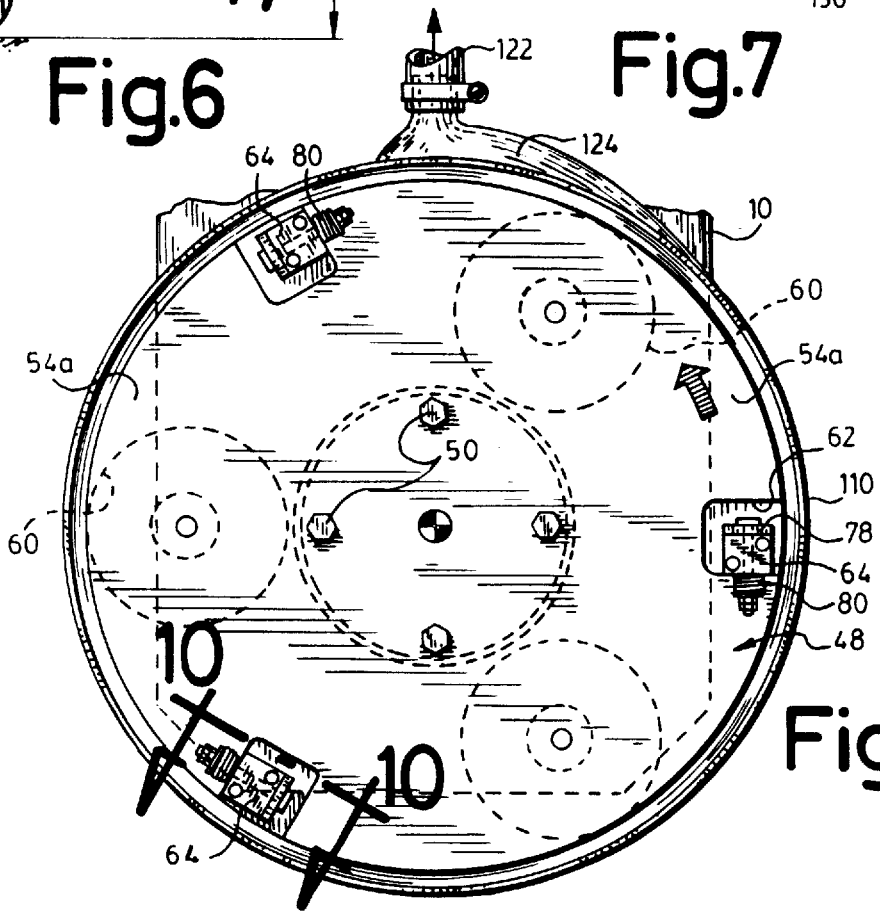
FIG. 8 is a bottom plan view of the machine taken along line 8—8 of FIG. 3.

Referring to FIGS. 5, 6, and 7, it is seen that the two wheels 12 can be raised or lowered with respect to the support frame 10. The shaft 134 of each wheel is fixed to a block 136 which is pivoted intermediate its ends on a pivot pin 138 transverse to the wheel shaft 134 and mounted in bracket 139 secured to frame 10. A pair of bolts 140 are screwed to the support frame 10 and engages block 136 on either side of pivot 138 so as to adjust the level of each wheel 12 independently of each other with respect to the support frame 10. Once properly adjusted the bolts 140 are fixed in position by lock nuts 142.

This adjustment system permits to adjust the transverse inclination of the work plate with respect to frame 10 so that the working plane of the cutter inserts or sandpaper discs will be parallel to the floor being worked. It is a simple matter to make the adjustment: first, the two wheels are raised so as to allow either the sandpaper disks 60 or the cutter inserts 78 to rest on the floor and the wheels are brought down to the floor and locked into adjusted position. In this manner, one is sure that the cutter inserts or sandpaper discs will properly work the floor. The belt 32 is provided with a belt tightening device (not shown) which applies sufficient tension for proper driving of the work plate but which allows belt slipping on either one of the two pulleys 20 and 26 should an obstruction prevent proper rotation of the work plate 48.

Normally, an electric motor of a fixed speed is provided whereby it is necessary to have a transmission such as the belt and pulley transmission provided with two speeds as previously described. Such an electric motor could be replaced by a variable speed electric motor in which case driving pulley 20*a* and driven pulley 26*a* would have a single belt receiving groove (FIGS. 17, 18). Alternately, a gasoline engine could be used to provide variable speed; in this case, it is necessary to have a proper clutching and de-clutching arrangement. Such an arrangement is shown in FIGS. 17 to 22. It consists of a belt tightening lever 144 pivoted intermediate its ends at 145 to the support frame 10 and having at its inner end a belt engaging roller 146 to roll on belt 32*a*. The outer end of lever 144 is biased by a coil spring 148 which biases lever 144 to belt tightening position in which lever 144 abuts against a stop pin 149 secured to frame 10. Lever 144 is remote-controlled by being attached to a cable 150, itself secured at its outer end to an actuating lever 152 pivoted intermediate its ends at 154 to the handle 104 in a position readily accessible to the operator B. Actuating lever 152 makes an acute angle with the handle in its cable releasing position in which belt tightening lever 144 tightens the belt under the action of spring 148. The actuating lever 152, when pivoted rearwardly towards the handle 104 as indicated by arrow 156 in FIG. 21, pulls cable 150 to bring lever 144 into belt releasing or de-clutching position; actuating lever 152 can be locked in this latter position by a locking pin 158 (see FIG. 22) which is spring biased to engage a hole 160 in handle 104. Releasing the locking pin by pulling on the same releases the actuating lever 152 and automatically permits clutching of the belt with the two pulleys 20*a* and 26*a* of the belt and pulley system. Cable 150 extends within frame 10 and handle 104 and is trained on guide rollers 162 and 164. Alternately, the fixed speed electric motor could also be used with a commonly known adjustable center distance driving pulley and a single belt receiving groove driven pulley arrangement, the latter requiring a belt tightening device similar to the belt tightening lever 144 to maintain a constant belt tension with variable driving pulley groove diameter.

Using a 220 volt electric motor 14, the machine of the invention can be transported by two men even up a stairway.

When using the cutter inserts, they are rotated at a lower speed but under a greater weight (using the belt and pulley drive 32 and 20, 26 and the weights 114) than when using sand paper discs 60.

Cutter inserts 78 are preferably of carbide but could be made of a hard steel alloy.

When used to remove tile black adhesive, the machine is pulled rearwardly to prevent the hot adhesive from adhering to the cutter inserts and the operator's B working boots.

We claim:

1. A combined floor covering stripping and floor re-surfacing machine comprising:

a support frame;

floor engaging wheels carried by said support frame;

steering means mounted on said support frame for steering the frame across a floor;

motor means mounted on said support frame;

a rotatable drive plate rotated by said motor means under said support frame about a generally vertical axis;

a reversible work plate having two opposite main faces and removably secured to said drive plate under the latter to take a first position with one main face lowermost and a second position with the other main face lowermost;

annularly disposed cutter blocks secured to said reversible work plate at one main face thereof;

a cutter insert secured to each cutter block and protruding from said one main face; and annularly disposed abrasive carrying devices secured to and protruding from the other main face of said reversible work plate whereby both a floor covering stripping operation and a floor re-surfacing operation can be effected by the same machine by securing said work plate to said drive plate in said first and second positions respectively.

2. A machine as defined in claim 1, further including a change speed system interconnecting said motor means and said drive plate to enable rotation of said work plate at a lower speed when it is in its first position than when it is in its second position.

3. A machine as defined in claim 2, wherein said change speed system includes a driving and a driven pulley each having two complementary belt receiving grooves of different diameters, and a belt selectively trained in complementary grooves of both pulleys, said belt capable of slipping in said grooves upon application unto said drive plate of a rotation obstructing force exceeding a predetermined value.

4. A machine as defined in claim 1, wherein said steering means includes a handle secured to said support frame and wherein said support frame is elongated and said wheels includes a pair of wheels mounted on each side of said support frame, said drive plate and said handle carried by opposite portions of said support frame relative to the axis of said wheels and further including longitudinally adjustable weights carried by said frame to adjustably bias said work plate against said floor.

5. A machine as defined in claim 4, further including a change speed system interconnecting said motor means and said drive plate to enable rotation of said work plate at a lower speed when it is in its first position than when it is in its second position.

6. A machine as defined in claim 5, wherein said change speed system includes a driving pulley and a driven pulley each having two complementary belt receiving grooves of different diameters and a belt selectively trained in complementary grooves of both pulleys, said belt capable of slipping on said pulleys upon application unto said drive plate of a rotation obstructing force exceeding a predetermined value.

7. A machine as defined in claim 4, further including means to independently adjust the level of each wheel of said pair of wheels relative to said support frame.

8. A machine as defined in claim 1, wherein each cutter block has a front radially extending cutter insert abutting face and a lip forwardly protruding from said face, each cutter insert being a many-sided flat thick blade with a pair of spaced parallel straight cutting edges formed along each side, and a spring-loaded bolt means extending through said cutter block and through said blade and resiliently retaining said blade flat against said cutter insert abutting face with said lip close to one side of said blade to prevent its rotation about said bolt means, said bolt means axially displaceable to permit said blade to clear said lip to be rotated so that another of its sides will come close to said lip, said blade reversibly mounted on said bolt means.

9. A machine as defined in claim 8, wherein said blade is square, having four sides, each forming two cutting edges.

10. A machine as defined in claim 8, wherein said blade is hexagonal, having six sides, each side forming two cutting edges.

11. A machine as defined in claim 8, wherein said steering means include a handle secured to said support frame and wherein said support frame is elongated and said wheels include a pair of wheels mounted on each side of said support frame, said drive plate and said handle carried by opposite portions of said support frame relative to the axis of said wheels, and further including longitudinally adjustable weights carried by said support frame to adjustably bias said reversible work plate against said floor.

12. A machine as defined in claim 4, further including a power-operated vacuum cleaner unit mounted on said support frame in counterbalancing relation about wheel axis relative to said drive plate and to said motor means, a shroud carried by said support frame and including a skirt surrounding said drive and work plates and an air inlet mouth formed by said skirt in the rotational plane of said work plate and close to the periphery of the latter, said mouth connected to said vacuum cleaner unit.

13. A machine as defined in claim 12, wherein each cutter block has a front radially extending cutter insert abutting face and a lip forwardly protruding from said face, each cutter insert being a many-sided flat thick blade with a pair of spaced parallel straight cutting edges formed along each side, and a spring-loaded bolt means extending through said cutter block and through said blade and resiliently retaining said blade flat against said cutter insert abutting face with said lip close to one side of said blade to prevent its rotation about said bolt means, said bolt means axially displaceable to permit said blade to clear said lip to be rotated so that another of its sides will come close to said lip, said blade reversibly mounted on said bolt means.

14. A machine as defined in claim 1, wherein said steering means include a handle secured to said support frame and wherein said motor means is an internal combustion engine and further including a transmission system interconnecting said engine and said drive plate and including a driving pulley, a driven pulley and a transmission belt trained on said pulleys, and a belt tightening means comprising a spring-biased belt engaging and tightening first lever mounted on said frame intermediate said driving and driven pulleys and an actuating second lever mounted on said handle and accessible to an operator of said machine, cable means interconnecting said first and second levers and releasable second lever locking means to releasably lock said second lever in a declutching position causing said cable means to maintain said first lever in a belt releasing position against the bias of said spring.

* * * * *